US011738986B2

(12) United States Patent
Mullenaux

(10) Patent No.: US 11,738,986 B2
(45) Date of Patent: Aug. 29, 2023

(54) REFILLABLE BOTTLE

(71) Applicant: AQUAPHANT, INC., Las Vegas, NV (US)

(72) Inventor: Thomas Mullenaux, San Pedro, CA (US)

( * ) Notice: Subject to any disclaimer, the term of this patent is extended or adjusted under 35 U.S.C. 154(b) by 136 days.

(21) Appl. No.: 17/380,178

(22) Filed: Jul. 20, 2021

(65) Prior Publication Data

US 2022/0259033 A1 Aug. 18, 2022

Related U.S. Application Data

(63) Continuation-in-part of application No. 17/176,350, filed on Feb. 16, 2021.

(51) Int. Cl.
*B67D 1/08* (2006.01)
*A47G 19/22* (2006.01)

(52) U.S. Cl.
CPC ..... *B67D 1/0894* (2013.01); *A47G 19/2205* (2013.01); *B67D 2001/0812* (2013.01)

(58) Field of Classification Search
CPC ..... B67D 1/0894; B05B 11/00446
USPC ..... 141/113, 360–366
See application file for complete search history.

(56) References Cited

U.S. PATENT DOCUMENTS 3,592,244 A * 7/1971 Chamberlin ..... B05B 7/2416 141/3
3,745,596 A 7/1973 Copeland
5,090,075 A 2/1992 Larson
D342,393 S 12/1993 Discepolo
5,271,837 A 12/1993 Discepolo
5,758,700 A * 6/1998 Vanderploeg ..... B67D 1/0835 99/323.1
6,513,343 B2 2/2003 Pahl
7,455,082 B2 * 11/2008 Monzel ..... B08B 9/0813 141/2
7,766,057 B2 * 8/2010 Windmiller ..... B67D 1/0081 141/2
8,151,838 B2 * 4/2012 Seaborne ..... B65D 1/06 141/356
8,176,948 B2 * 5/2012 Carrig ..... H04W 4/08 141/82
8,777,182 B2 * 7/2014 Springer ..... A47G 19/2205 137/499
8,997,803 B2 * 4/2015 Fallon ..... B67D 1/0888 141/198
2011/0121020 A1 * 5/2011 Springer ..... A47G 19/2205 222/23
2012/0103926 A1 * 5/2012 Ibsies ..... B65D 1/06 141/113
2016/0231029 A1 8/2016 Pan

* cited by examiner

*Primary Examiner* — Timothy L Maust
(74) *Attorney, Agent, or Firm* — Kyle A. Fletcher, Esq.

(57) ABSTRACT

The refillable drinking vessel comprises a bottle, a bottle fitting structure, a base plate, and a fluid control structure. The base plate forms a fluidic connection between the bottle fitting structure and a pressurized fluid source. The bottle fitting structure forms a fluidic connection between the bottle and the base plate. The fluid control structure automatically controls the flow of fluid from the pressurized fluid source through the base plate and the bottle fitting structure into the bottle. The fluid control structure senses when the bottle is near the base plate. The fluid control structure measures and controls the amount of fluid contained in the bottle.

15 Claims, 6 Drawing Sheets

REFILLABLE BOTTLE

CROSS REFERENCES TO RELATED APPLICATIONS

This non-provisional application claims priority under 35 USC 120 to U.S. non-provisional application U.S. Ser. No. 17/176,350 filed on Feb. 16, 2021 by the inventor: Thomas Mullenaux. This non-provisional application claims U.S. non-provisional application U.S. Ser. No. 17/176,350 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of table service including drinking vessels. (A47G19/22)

Background

This non-provisional application claims priority under 35 USC 120 to U.S. non-provisional application U.S. Ser. No. 17/176,350 filed on Feb. 16, 2021 by the inventor: Thomas Mullenaux. This non-provisional application claims U.S. non-provisional application U.S. Ser. No. 17/176,350 in its entirety.

The present disclosure will only reference the elements of the non-provisional application U.S. Ser. No. 17/176,350 that are relevant to the innovations disclosed within this application. This is done for purposes of simplicity and clarity of exposition. The applicant notes that this disclosure incorporates non-provisional application U.S. Ser. No. 17/176,350 in its entirety into this application. The fact that any specific innovation selected from the one or more innovations disclosed within U.S. Ser. No. 17/176,350 is not addressed in this application should not be interpreted as an indication of defect in the above referenced patent.

Within this disclosure, the non-provisional application U.S. Ser. No. 17/176,350 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure is a fluid containment structure. The prior disclosure is an automatic structure. By automatic is meant that, after the prior disclosure forms a fluidic connection with a pressurized fluid source the prior disclosure: a) opens a fluidic connection with the pressurized fluid source; and, b) receives fluid from the pressurized fluid source until a previously determined volume of fluid is contained in the prior disclosure. The prior disclosure comprises a bottle, a bottle fitting structure, a base plate, and a fluid control structure. The base plate forms a fluidic connection between the bottle fitting structure and the pressurized fluid source. The bottle fitting structure forms a fluidic connection between the bottle and the base plate. The fluid control structure automatically controls the flow of fluid from the pressurized fluid source through the base plate and the bottle fitting structure into the bottle.

SUMMARY OF INVENTION

The refillable drinking vessel comprises a bottle, a bottle fitting structure, a base plate, and a fluid control structure. The base plate forms a fluidic connection between the bottle fitting structure and a pressurized fluid source. The bottle fitting structure forms a fluidic connection between the bottle and the base plate. The fluid control structure automatically controls the flow of fluid from the pressurized fluid source through the base plate and the bottle fitting structure into the bottle. The fluid control structure senses when the bottle is near the base plate. The fluid control structure measures and controls the amount of fluid contained in the bottle.

These together with additional objects, features and advantages of the refillable drinking vessel will be readily apparent to those of ordinary skill in the art upon reading the following detailed description of the presently preferred, but nonetheless illustrative, embodiments when taken in conjunction with the accompanying drawings.

In this respect, before explaining the current embodiments of the refillable drinking vessel in detail, it is to be understood that the refillable drinking vessel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the refillable drinking vessel.

It is therefore important that the claims be regarded as including such equivalent construction insofar as they do not depart from the spirit and scope of the refillable drinking vessel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

This non-provisional application claims priority under 35 USC 120 to U.S. non-provisional application U.S. Ser. No. 17/176,350 filed on Feb. 16, 2021 by the inventor: Thomas Mullenaux. This non-provisional application claims U.S. non-provisional application U.S. Ser. No. 17/176,350 in its entirety.

Figure 1:
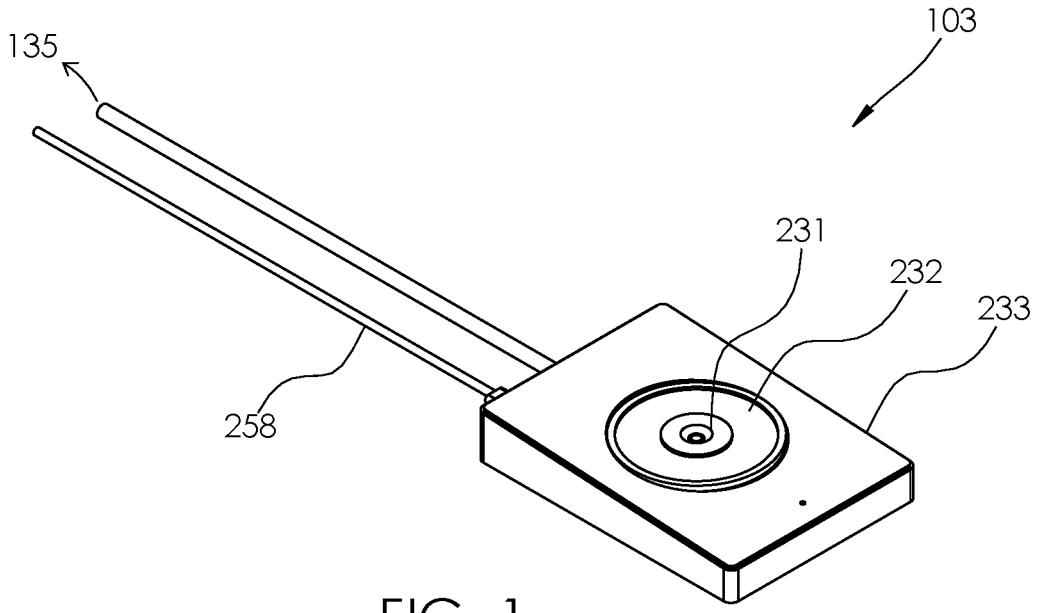
FIG. 1 is a perspective view of an embodiment of the disclosure.
Figure 2:
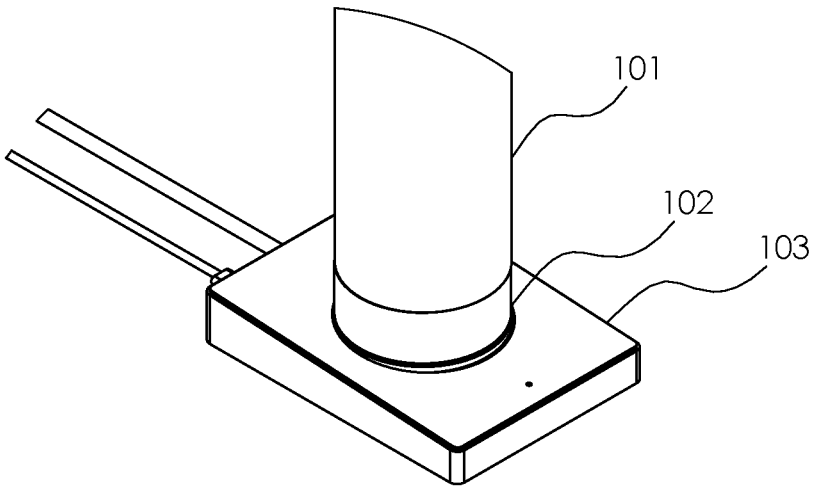
FIG. 2 is a perspective view of an embodiment of the disclosure.
Figure 3:
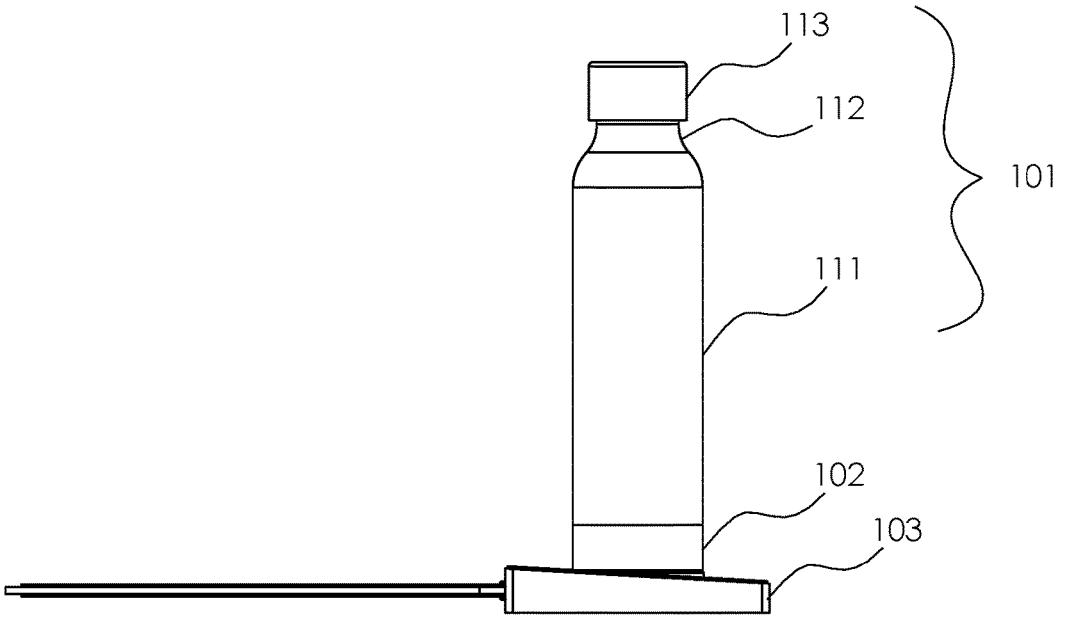
FIG. 3 is a front view of an embodiment of the disclosure.
Figure 4:
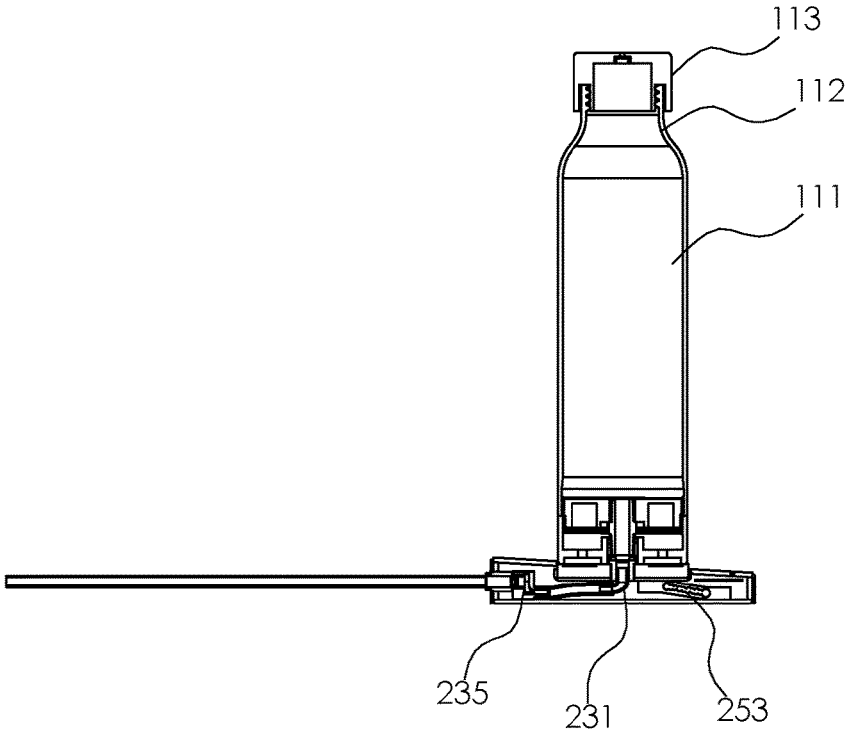
FIG. 4 is a cross-sectional view of an embodiment of the disclosure.
Figure 5:
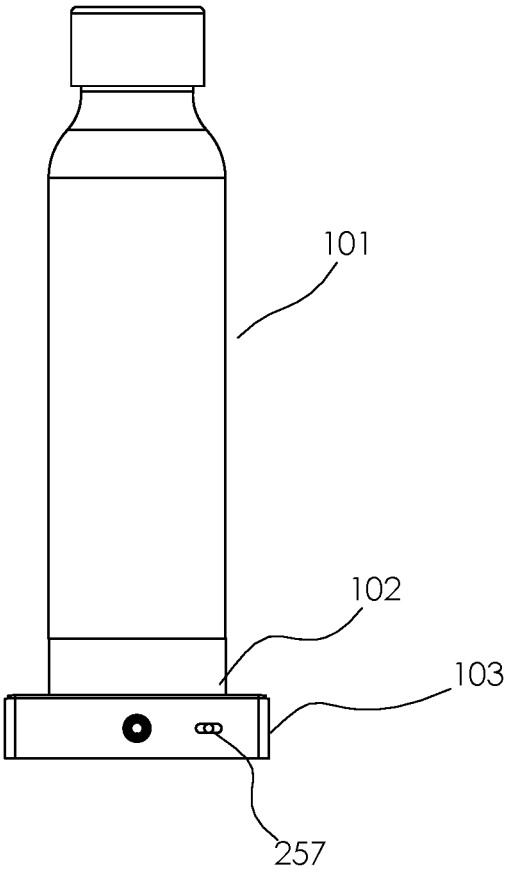
FIG. 5 is a side view of an embodiment of the disclosure.
Figure 6:
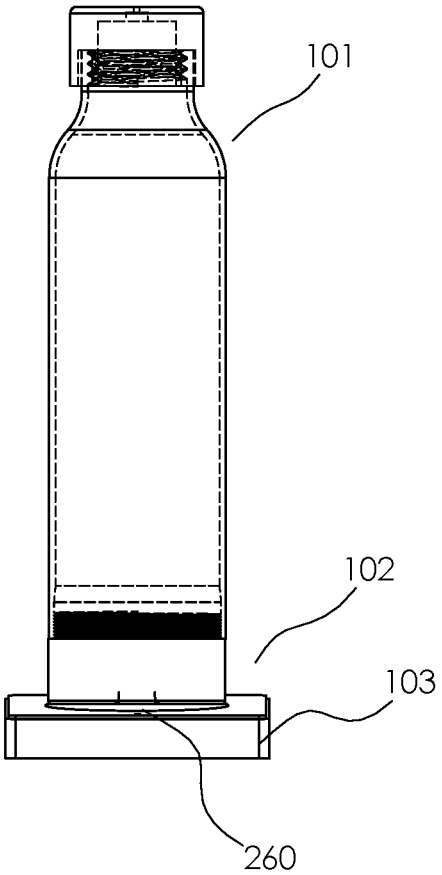
FIG. 6 is a side view of an embodiment of the disclosure.
Figure 7:
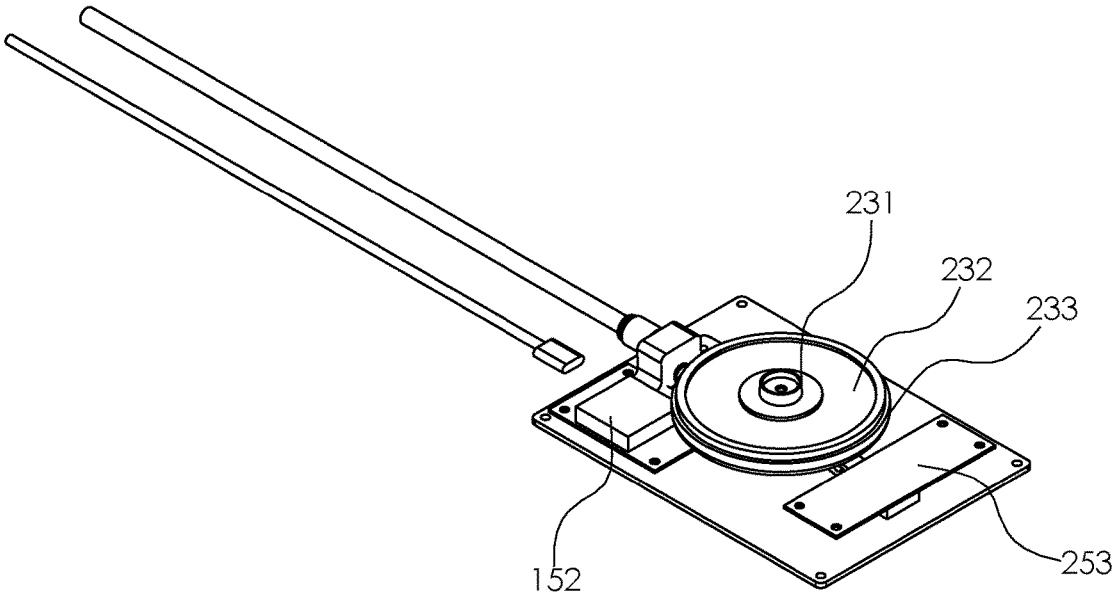
FIG. 7 is a perspective view of an embodiment of the disclosure.
Figure 8:
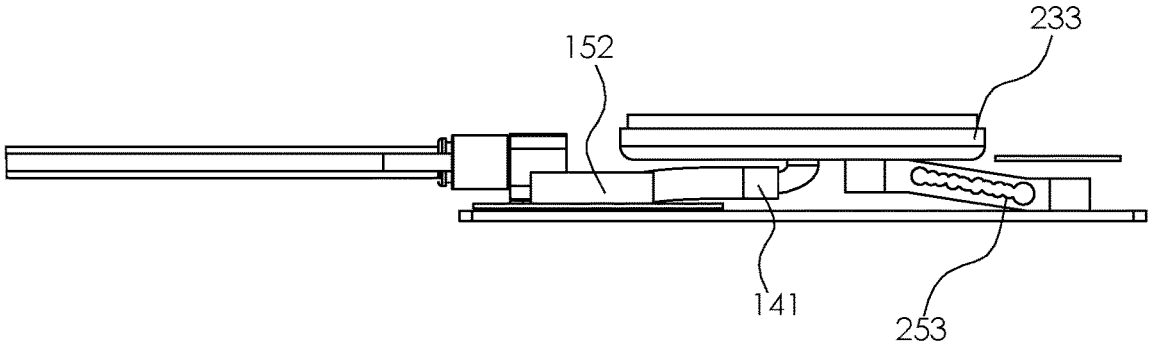
FIG. 8 is a front view of an embodiment of the disclosure.
Figure 9:
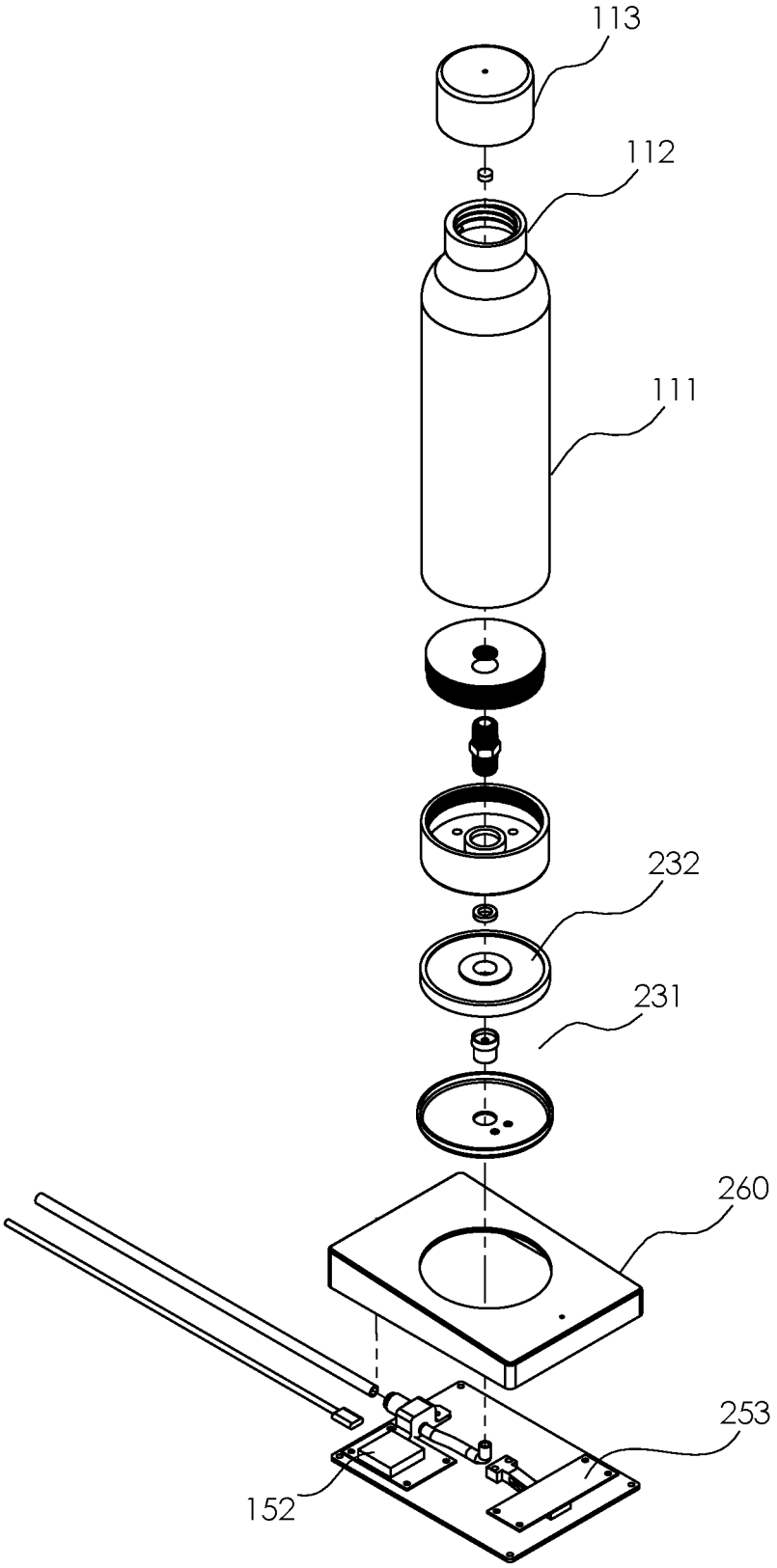
FIG. 9 is an exploded view of an embodiment of the disclosure.
Figure 10:
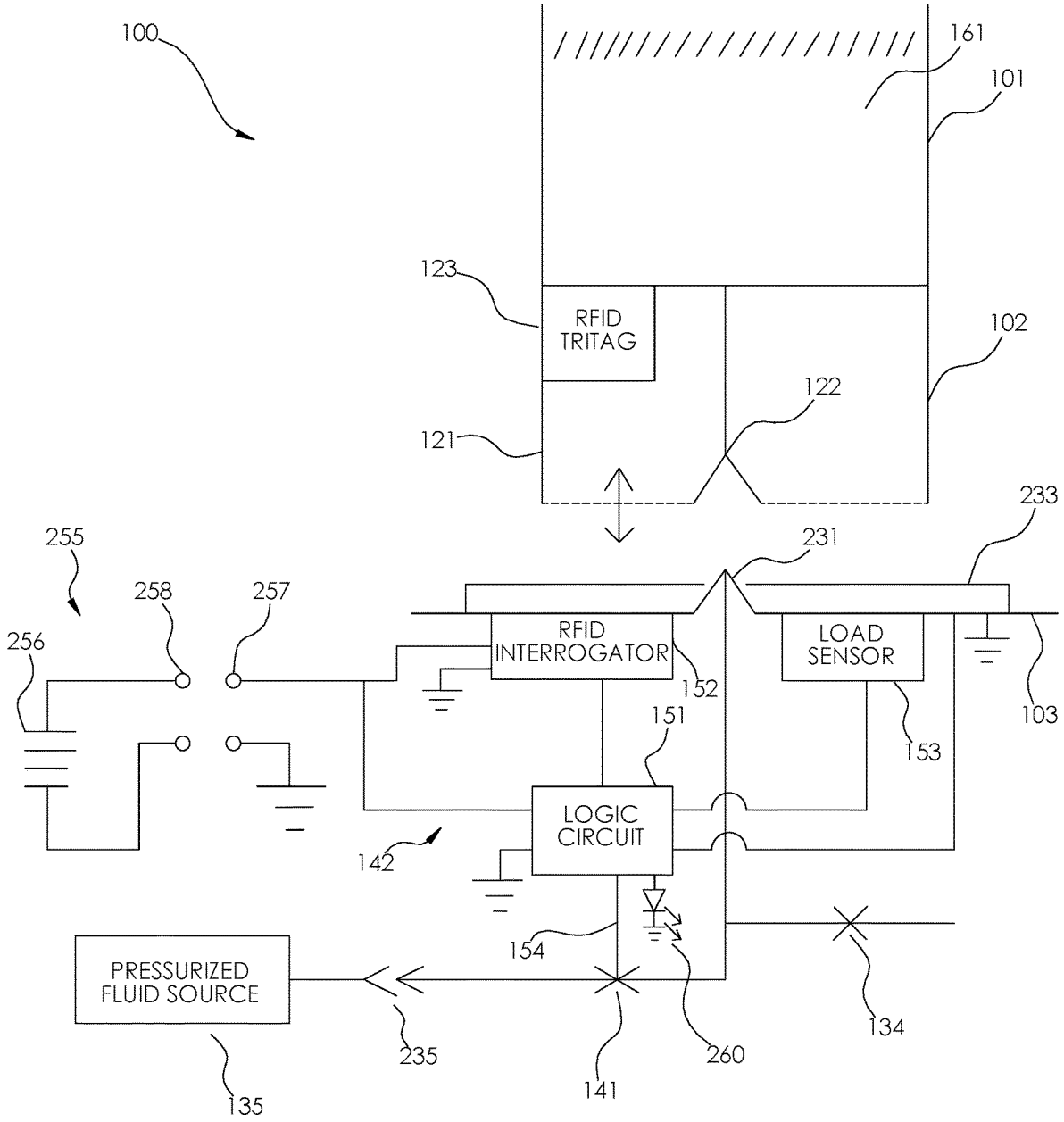
FIG. 10 is a schematic view of an embodiment of the disclosure.
Figure 10:
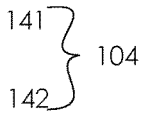

Detailed reference will now be made to one or more potential embodiments of the disclosure, which are illustrated in FIGS. 1 through 10.

The refillable drinking vessel 100 (hereinafter invention) comprises a bottle 101, a bottle 101 fitting structure 102, a base plate 103, and a fluid 161 control structure 104. The base plate 103 forms a fluidic connection between the bottle 101 fitting structure 102 and a pressurized fluid 161 source 135. The bottle 101 fitting structure 102 forms a fluidic connection between the bottle 101 and the base plate 103. The fluid 161 control structure 104 automatically controls the flow of fluid 161 from the pressurized fluid 161 source 135 through the base plate 103 and the bottle 101 fitting structure 102 into the bottle 101. The fluid 161 control structure 104 senses when the bottle 101 is near the base plate 103. The fluid 161 control structure 104 measures and controls the amount of fluid 161 contained in the bottle 101.

The pressurized fluid 161 source 135 is an externally provided source of a fluid 161 under pressure. The applicant assumes that the fluid 161 is potable water.

The bottle 101 is a fluid 161 containment vessel. The bottle 101 stores a fluid 161 in anticipation of consumption. The bottle 101 is an enclosable structure. By enclosable structure is meant that the bottle 101 forms a fluid 161 impermeable structure that encloses the fluid 161 within the bottle 101. The bottle 101 is defined elsewhere in this disclosure. The bottle 101 comprises a flask 111, a neck 112, and a bottle 101 cap 113.

The flask 111 forms the fluid 161 containment structure of the bottle 101. The flask 111 has a pan shape. The flask 111 is defined elsewhere in this disclosure. The neck 112 is a mechanical structure. The neck 112 encloses the open face of the flask 111. The neck 112 forms a tubular structure such that the fluid 161 will flow out of the flask 111 through the neck 112. The neck 112 is defined elsewhere in this disclosure. The bottle 101 cap 113 is a lid. The bottle 101 cap 113 encloses the neck 112 such that the bottle 101 cap 113 and the neck 112 forms a fluid 161 impermeable seal that encloses the fluid 161 in the flask 111. The bottle 101 cap 113 is defined elsewhere in this disclosure.

The bottle 101 fitting structure 102 is an interface structure. The bottle 101 fitting structure 102 forms the fluidic connection between the base plate 103 and the bottle 101. The bottle 101 fitting structure 102 mounts on the closed face of the pan structure of the flask 111 of the bottle 101. The bottle 101 fitting structure 102 mechanically attaches to the base plate 103. The bottle 101 fitting structure 102 encloses the superior surfaces of the base plate 103. The bottle 101 fitting structure 102 comprises a base plate 103 cover 121, a bottle 101 intake fitting 122, and an RFID tracking tag 123.

The base plate 103 cover 121 is a pan shaped structure. The negative space of the base plate 103 cover 121 is geometrically similar to the stainless steel plate 232 of the base plate 103 such that the stainless steel plate 232 inserts into the base plate 103 cover 121. The base plate 103 cover 121 physically secures the bottle 101 fitting structure 102 to the base plate 103. The bottle 101 intake fitting 122 is a fitting.

The base plate 103 cover 121 is formed from a magnetic material. The bottle 101 intake fitting 122 physically connects to the silicone fitting 231 of the base plate 103 to form a fluidic connection with the base plate 103. The bottle 101 intake fitting 122 forms a fluid 161 impermeable connection with the silicone fitting 231. The bottle 101 intake fitting 122 transports the pressurized fluid 161 received from the base plate 103 into the flask 111.

The RFID tracking tag 123 mounts in the bottle 101 fitting structure 102. Specifically, the RFID tracking tag 123 is an antenna that mounts in the base plate 103 cover 121. The RFID tracking tag 123 is a reflective structure. The RFID tracking tag 123 receives a radio frequency signal (known as an interrogation signal) from the RFID interrogator 152 of the control circuit 142 of the fluid 161 control structure 104. The RFID tracking tag 123 modifies the waveform of the received radio frequency signal. The RFID tracking tag 123 reflects the modified waveform back to the RFID interrogator 152 as a responding signal. The RFID tracking tag 123 is used by the fluid 161 control system 104 to identify the location of the bottle 101 fitting structure 102 relative to the base plate 103. The RFID tracking tag 123 is defined elsewhere in this disclosure.

The base plate 103 is a mechanical structure. The bottle fitting structure 102 secures the bottle 101 to the base plate 103. The bottle 101 fitting structure 102 removably attaches to the base plate 103. The bottle 101 fitting structure 102 is magnetically secured to the base plate 103.

The base plate 103 forms a pedestal that transfers the loads of the bottle 101 and the bottle 101 fitting structure 102 to a supporting surface. The base plate 103 forms a detachable fluidic connection 235 between the pressurized fluid 161 source 135 and the bottle 101 fitting structure 102. The fluid 161 control structure 104 mounts in the base plate 103. The base plate 103 forms a safety structure that releases excess pressure that occurs within the pressurized fluid 161 source 135. The form factor of the base plate 103 is formed such that the base plate 103 inserts into the base plate 103 cover 121 when the bottle 101 fitting structure 102 attaches to the base plate 103.

The base plate 103 comprises a silicone fitting 231, a stainless steel plate 232, an electromagnetic mount 233, and a relief valve 134. The base plate 103 forms the detachable fluidic connection 235 with the pressurized fluid 161 source 135. The detachable fluidic connection 235 is a fitting. The fluid 161 flowing through the base plate 103 enters the base plate 103 through the detachable fluidic connection 235.

The silicone fitting 231 is a fitting. The silicone fitting 231 forms a fluidic connection to the pressurized fluid source 135. The silicone fitting 231 physically connects to the bottle 101 intake fitting 122 of the bottle 101 fitting structure 102 to form a fluidic connection. The silicone fitting 231 forms a fluid 161 impermeable connection with the bottle 101 intake fitting 122. The silicone fitting 231 transports the fluid 161 received from the pressurized fluid 161 source 135 to the bottle 101 intake fitting 122. The silicone fitting 231 is molded from silicone.

The stainless steel plate 232 is a mechanical structure. The stainless steel plate 232 houses the silicone fitting 231, the relief valve 134, and the fluid 161 control structure 104. The electromagnetic mount 233 attaches to the exterior surface of the stainless steel plate 232. The stainless steel plate 232 rests the base plate 103 on a supporting surface.

The electromagnetic mount 233 is an electromagnet that attaches to the stainless steel plate 232. The electromagnetic mount 233 is an electromagnetic structure that draws electric energy from the fluid 161 control structure 104. The electromagnetic mount 233 is geometrically similar to the base plate 103 cover 121. The base plate 103 cover 121 inserts into the electromagnetic mount 233 such that the electromagnetic mount 233 magnetically secures the base plate 103 cover 121 to the base plate 103.

The relief valve 134 is a safety valve. The relief valve 134 is a pressure sensitive valve. The relief valve 134 automatically opens when the pressure of the fluid 161 received from the pressurized fluid 161 source 135 is greater than a predetermined pressure.

The fluid 161 control structure 104 is a control system. The fluid 161 control structure 104 confirms that the bottle 101 has a fluidic connection with the base plate 103. The fluid 161 control structure 104 controls the flow of the fluid 161 from the base plate 103 into the bottle 101. By controlling the flow of fluid 161 into the bottle 101 is meant that the fluid 161: a) monitors the mass of fluid 161 within the bottle 101; b) initiates the flow of fluid 161 into the bottle 101 when the mass of fluid 161 falls below a predetermined mass and, c) discontinues the flow of fluid 161 into the bottle 101 when the fluid 161 in the bottle 101 reaches the predetermined mass. The fluid 161 control structure 104 comprises a solenoid valve 141 and a control circuit 142. The control circuit 142 electrically connects to the solenoid valve 141.

The solenoid valve 141 is an electrically controlled valve. The solenoid valve 141 mounts in the base plate 103. The control circuit 142 controls the operation of the solenoid valve 141. The solenoid valve 141 controls the flow of the pressurized fluid 161 from the bottle 101 intake fitting 122 into the flask 111 of the bottle 101. The solenoid valve 141 fluidically connects to the detachable fluidic connection 235. The solenoid valve 141 receives the fluid 161 under pressure from the detachable fluidic connection 235. The discharge of the solenoid valve 141 is fluidically connected to the silicone fitting 231. The discharge of the solenoid valve 141 is further fluidically connected to the relief valve 134. The solenoid and the solenoid valve 141 are defined elsewhere in this disclosure.

The control circuit 142 is an electromechanical structure. The control circuit 142 mounts in the base plate 103. The control circuit 142 controls the flow of the fluid 161 from the detachable fluidic connection 235, through the solenoid valve 141, and into the silicone fitting 231. The control circuit 142 detects the presence of the RFID tracking tag 123 of the bottle 101 fitting structure 102. The control circuit 142 measures the mass of the fluid 161 in the flask 111. The control circuit 142 opens the solenoid valve 141 to allow the flow of fluid 161 through the silicone fitting 231 when the mass of fluid 161 in the flask 111 falls below the predetermined mass. The control circuit 142 closes the solenoid valve 141 to discontinue the flow of fluid 161 through the silicone fitting 231 when the mass of fluid 161 in the flask 111 reaches the predetermined mass.

The control circuit 142 comprises a logic circuit 151, an RFID interrogator 152, a load sensor 253, and a power circuit 255. The logic circuit 151, the RFID interrogator 152, the load sensor 253, and the power circuit 255 are electrically interconnected. The logic circuit 151 further comprises a solenoid valve 141 control signal 154. The RFID interrogator 152 electrically connects with the logic circuit 151. The load sensor 253 electrically connects with the logic circuit 151. The logic circuit 151 electrically connects to the solenoid valve 141 using the solenoid valve 141 control signal 154. The RFID interrogator 152 interacts with the RFID tracking tag 123. The power circuit 255 provides electric power to the logic circuit 151, the RFID interrogator 152, the load sensor 253, and the electromagnetic mount 233.

The logic circuit 151 is an electric circuit. The logic circuit 151 controls the operation of the solenoid valve 141 based on inputs received from the RFID interrogator 152 and the load sensor 253. The logic circuit 151 monitors and controls the operation of the RFID interrogator 152. The logic circuit 151 monitors the operation of the load sensor 253. The solenoid valve 141 control signal 154 is an electrical connection between the logic circuit 151 and the solenoid valve 141. The logic circuit 151 generates and transmits the solenoid valve 141 control signal 154 to the solenoid valve 141 to actuate the solenoid valve 141.

The logic circuit 151 further comprises an LED 260. The LED 260 electrically connects to the logic circuit 151. The logic circuit 151 controls the operation of the LED 260. The LED 260 mounts on the base plate 103 such that the LED 260 is visible from the exterior of the base plate 103. The logic circuit 151 illuminates the LED 260 when the logic circuit 151 actuates the solenoid valve 141 to the open position.

The load sensor 253 is a sensor that measures the mass of the fluid 161 that is contained in the flask 111. The logic circuit 151 monitors the load sensor 253 to determine if the fluid 161 is at the predetermined mass level. In the first potential embodiment of the disclosure, the load sensor 253 is a load cell.

The RFID interrogator 152 is a radio frequency transceiver. The RFID interrogator 152 transmits a radio frequency interrogation signal to the RFID tracking tag 123 in the base plate 103 cover 121. The RFID interrogator 152 monitors the environment for a reflected response signal to the interrogation signal from the RFID tracking tag 123. When the RFID interrogator 152 detects the response signal, the RFID interrogator 152 sends an electrical signal to the logic circuit 151 indicating that the bottle 101 fitting structure 102 is attached to the base plate 103.

When the RFID interrogator 152 receives the responding signal, the RFID interrogator 152 transmits a signal to the logic circuit 151 indicating that it has detected the RFID tracking tag 123 in the bottle 101 fitting structure 102. The logic circuit 151 uses the responding signal to indicate that the base plate 103 has been properly inserted into the base plate 103 cover 121 of the bottle 101 fitting structure 102 and that it is appropriate to open the solenoid valve 141 to refill the flask 111 of the bottle 101.

The power circuit 255 is an electric circuit that provides the electric energy required to power the fluid 161 control structure 104 and the electromagnetic mount 233. The power circuit 255 further comprises an external power source 256, a power port 257, and a power plug 258. The power plug 258 forms a detachable electric connection between the power port 257 and the external power source 256. The external power source 256 is an externally provided source of electric energy. The external power source 256 is defined elsewhere in this disclosure. The power port 257 physically attaches to the base plate 103. The power port 257 distributes electric energy from the external power source 256 to the fluid 161 control structure 104 and the electromagnetic mount 233. The power plug 258 removably inserts into the power port 257 to form the electrical connection between the external power source 256 and the power port 257.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Antenna: As used in this disclosure, an antenna is an electrical apparatus used to: a) convert electrical current into electromagnetic radiation; and, b) convert electromagnetic radiation into electrical current. An antenna is a type of transducer.

Automatic: As used in this disclosure, automatic refers to a device, process, or a system that operates without human control, supervision or participation in the operation of the device, process, or system. The verb form of automatic is to automate.

Bottle: As used in this disclosure, a bottle is a container used for the storage of fluids. A bottle generally comprises a flask and a neck. The flask is a pan shaped containment structure. The neck is a tubular structure that provides access to the interior of the flask. The neck comprises: a) a tube structure that forms an aperture through which fluids can be introduced and removed from the bottle; and, b) a physical structure that encloses the open face of the pan structure of the flask such that the inner diameter of the neck need not be identical to the inner diameter of the flask.

Bottle Cap: As used in this disclosure, a bottle cap refers to a lid that is used to enclose the open neck of a bottle. A disposable bottle cap refers to a bottle cap that must be pried off of the neck of the bottle. A reusable bottle cap refers to a bottle cap that attaches to the neck of the bottle using a threaded connection.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Conductive Sensor: As used in this disclosure, a conductive sensor is a sensor used to detect the presence of a conductive liquid such as water. The conductive sensor comprises two electric terminals that present an electric voltage across them. An electric current passes between the two electrodes when the conductive liquid simultaneously immerses the two electrodes. A conductive sensor can be used to detect when the conductive liquid reaches a previously determined level by the placement of one of the two electrodes at that level.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electromagnet: As used in this disclosure, an electromagnet is a core formed from a magnetic material that has a coil formed from an electric current carrying conductor wrapped around it. When an electric current flows through the coil, The core exhibits magnetic properties when an electric current flows through the coil and exhibits no (or reduced) magnetic properties when electric current is not flowing through the coil.

External Power Source: As used in this disclosure, an external power source is a source of the energy that is externally provided to enable the operation of the present disclosure. Examples of external power sources include, but are not limited to, electrical power sources and compressed air sources.

Fitting: As used in this disclosure, a fitting is a component that attaches a first object to one or more additional objects. The fitting is often used to forming a fluidic connection between the first object and the one or more additional objects.

Float Switch: As used in this disclosure, a float switch is a commercially available switch that is actuated by the level of liquid contained within a contained space. A common use of a float switch is in the operation of a bilge or sump pump. Specifically, when the level of accumulated liquid in a bilge or a sump exceeds a predetermined level, the float switch will actuate into a closed position that completes an electric circuit that provides electrical power to a pump that will remove the liquid from the bilge or sump. When the accumulated liquid falls below the predetermined level the float switch will actuate into an open position discontinuing the operation of the pump.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interface: As used in this disclosure, an interface is a physical or virtual boundary that separates two different systems and across which occurs an exchange.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole).

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

Mount: As used in this disclosure, a mount is a mechanical structure that attaches or incorporates a first object to a second object.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

RFID: As used in this disclosure, RFID refers to Radio Frequency Identification technology. RFID is a wireless technology that uses an electromagnetic field to identify and retrieve data from tracking tags that are placed on or near an object.

RFID Interrogator: As used in this disclosure, an RFID interrogator is a device that transmits a radio signal at frequency designed to activate RFID tracking tags that are tuned to operate at that frequency; b) receives a modified reflected signal from each of the RFID tracking tags that were activated by the transmitted radio signal; c) decodes the information contained in the received modified reflected signal for each of the activated RFID tracking tag; and, d) forwards the decoded information to a designated device or process for subsequent processing.

RFID Tracking Tag: As used in this disclosure, an RFID tracking tag is a reflective antenna that receives a radio signal from an RFID Interrogator and uses the energy received from the RFID interrogator signal to reflect a modified signal back to the RFID interrogator. The modified signal generally contains identification information about the RFID tag. The RFID interrogator receives and records these reflected signals. RFID tags are generally tuned to respond to a specific frequency. The RFID tracking tag as described to this point is a passive, or unpowered RFID tracking tag. There are also available within RFID technology active, or powered, RFID tracking tags. An active RFID tracking tag acts as a beacon that actively transmits identification information in a manner that can be received and recorded by an RFID interrogator. Within this disclosure, both passive and active RFID tracking tags are used.

Silicone: As used in this disclosure, silicone is a substance formed from silicon (Si) and oxygen (O) that forms the backbone of polymer type chains similar to polymers that are formed by carbon. Though exceptions do exist, silicone is generally considered to be less reactive and to have better heat resistance when compared to most common carbon based polymers.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port. A solenoid valve comprises a coil and a valve. The coil forms the solenoid that opens and closes the solenoid valve. The solenoid valve is a valve that opens and closes to control the fluid flow.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Valve: As used in this disclosure, a valve is a device that is used to control the flow of a fluid (gas or liquid) through a pipe, tube, or hose.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A refillable drinking vessel comprising a bottle fitting structure, a base plate, and a fluid control structure;

wherein the base plate forms a fluidic connection between the bottle fitting structure and a pressurized fluid source;

wherein the bottle fitting structure forms a fluidic connection between the bottle and the base plate;

wherein the fluid control structure automatically controls the flow of fluid from the pressurized fluid source through the base plate and the bottle fitting structure into the bottle;

wherein the base plate is a mechanical structure;

wherein the bottle fitting structure secures the bottle to the base plate;

wherein the bottle fitting structure removably attaches to the base plate;

wherein the bottle fitting structure is magnetically secured to the base plate;

wherein the base plate forms a detachable fluidic connection between the pressurized fluid source and the bottle fitting structure;

wherein the fluid control structure mounts in the base plate;

wherein the base plate forms a safety structure that releases excess pressure that occurs within the pressurized fluid source;

wherein a form factor of the base plate is formed such that the base plate inserts into a base plate cover when the bottle fitting structure attaches to the base plate.

2. The refillable drinking vessel according to claim 1 wherein the fluid control structure senses when the bottle is near the base plate;

wherein the fluid control structure measures and controls the amount of fluid contained in the bottle.

3. The refillable drinking vessel according to claim 2 wherein the pressurized fluid source is a source of a fluid under pressure.

4. The refillable drinking vessel according to claim 3 wherein the bottle is a fluid containment vessel;

wherein the bottle is an enclosable structure;

wherein by enclosable structure is meant that the bottle forms a fluid impermeable structure that encloses the fluid within the bottle.

5. The refillable drinking vessel according to claim 4 wherein the bottle fitting structure is an interface structure;

wherein the bottle fitting structure forms the fluidic connection between the base plate and the bottle;

wherein the bottle fitting structure mechanically attaches to the base plate;

wherein the bottle fitting structure encloses the superior surfaces of the base plate.

6. The refillable drinking vessel according to claim 5 wherein the fluid control structure is a control system;

wherein the fluid control structure confirms that the bottle has a fluidic connection with the base plate;

wherein the fluid control structure controls the flow of the fluid from the base plate into the bottle;

wherein by controlling the flow of fluid into the bottle is meant that the fluid: a) monitors the mass of fluid within the bottle; b) initiates the flow of fluid into the bottle when the mass of fluid falls below a predetermined mass and, c) discontinues the flow of fluid into the bottle when the fluid in the bottle reaches the predetermined mass.

7. The refillable drinking vessel according to claim 6 wherein the bottle comprises a flask, a neck, and a bottle cap;

wherein the flask forms the fluid containment structure of the bottle;

wherein the flask has a pan shape;

wherein the neck is a mechanical structure;

wherein the neck encloses the open face of the flask;

wherein the neck forms a tubular structure such that the fluid will flow out of the flask through the neck;

wherein the bottle cap is a lid;

wherein the bottle cap encloses the neck such that the bottle cap and the neck forms a fluid impermeable seal that encloses the fluid in the flask.

8. The refillable drinking vessel according to claim 7 wherein the bottle fitting structure mounts on the closed face of the pan structure of the flask of the bottle.

9. The refillable drinking vessel according to claim 8 wherein the bottle fitting structure comprises a base plate cover, a bottle intake fitting, and an RFID tracking tag;

wherein the base plate cover is a pan shaped structure;

wherein the negative space of the base plate cover is geometrically similar to the stainless steel plate of the base plate such that the stainless steel plate inserts into the base plate cover;

wherein the base plate cover physically secures the bottle fitting structure to the base plate.

10. The refillable drinking vessel according to claim 9 wherein the bottle intake fitting is a fitting;

wherein the base plate cover is formed from a magnetic material;

wherein the bottle intake fitting physically connects to the silicone fitting of the base plate to form a fluidic connection with the base plate;

wherein the bottle intake fitting forms a fluid impermeable connection with the silicone fitting;

wherein the bottle intake fitting transports the pressurized fluid received from the base plate into the flask.

11. The refillable drinking vessel according to claim 10 wherein the RFID tracking tag is an antenna that mounts in the base plate cover;

wherein the RFID tracking tag is a reflective structure;

wherein the RFID tracking tag is used by the fluid control system to identify the location of the bottle fitting structure relative to the base plate.

12. The refillable drinking vessel according to claim 11 wherein the base plate comprises a silicone fitting, a stainless steel plate, an electromagnetic mount, and a relief valve;

wherein the base plate forms the detachable fluidic connection with the pressurized fluid source;

wherein the detachable fluidic connection is a fitting;

wherein the fluid flowing through the base plate enters the base plate through the detachable fluidic connection;

wherein the silicone fitting is a fitting;

wherein the silicone fitting forms a fluidic connection to the pressurized fluid source;

wherein the silicone fitting physically connects to the bottle intake fitting of the bottle fitting structure to form a fluidic connection;

wherein the silicone fitting forms a fluid impermeable connection with the bottle intake fitting;

wherein the silicone fitting transports the fluid received from the pressurized fluid source to the bottle intake fitting;

wherein the silicone fitting is molded from silicone;

wherein the stainless steel plate is a mechanical structure;

wherein the stainless steel plate houses the silicone fitting, the relief valve, and the fluid control structure;

wherein the electromagnetic mount attaches to the exterior surface of the stainless steel plate;

wherein the stainless steel plate rests the base plate on a supporting surface;

wherein the electromagnetic mount is an electromagnet that attaches to the stainless steel plate;

wherein the electromagnetic mount is an electromagnetic structure that draws electric energy from the fluid control structure;

wherein the electromagnetic mount is geometrically similar to the base plate cover;

wherein the base plate cover inserts into the electromagnetic mount such that the electromagnetic mount magnetically secures the base plate cover to the base plate;

wherein the relief valve is a safety valve;

wherein the relief valve is a pressure sensitive valve;

wherein the relief valve automatically opens when the pressure of the fluid received from the pressurized fluid source is greater than a predetermined pressure.

13. The refillable drinking vessel according to claim 12 wherein the fluid control structure comprises a solenoid valve and a control circuit;

wherein the control circuit controls the operation of the solenoid valve.

14. The refillable drinking vessel according to claim 13 wherein the control circuit electrically connects to the solenoid valve;

wherein the solenoid valve is an electrically controlled valve;

wherein the solenoid valve mounts in the base plate;

wherein the solenoid valve controls the flow of the pressurized fluid from the bottle intake fitting into the flask of the bottle;

wherein the solenoid valve fluidically connects to the detachable fluidic connection;

wherein the solenoid valve receives the fluid under pressure from the detachable fluidic connection;

wherein the discharge of the solenoid valve is fluidically connected to the silicone fitting;

wherein the discharge of the solenoid valve is further fluidically connected to the relief valve.

15. The refillable drinking vessel according to claim 14 wherein the control circuit is an electromechanical structure;

wherein the control circuit mounts in the base plate;

wherein the control circuit controls the flow of the fluid from the detachable fluidic connection, through the solenoid valve, and into the silicone fitting;

wherein the control circuit detects the presence of the RFID tracking tag of the bottle fitting structure;

wherein the control circuit measures the mass of the fluid in the flask;

wherein the control circuit opens the solenoid valve to allow the flow of fluid through the silicone fitting when the mass of fluid in the flask falls below the predetermined mass;

wherein the control circuit closes the solenoid valve to discontinue the flow of fluid through the silicone fitting when the mass of fluid in the flask reaches the predetermined mass.

* * * * *